310-322 SR
5/29/79 XR 4,156,800

United States Patent [19] [11] 4,156,800
Sear et al. [45] May 29, 1979

[54] PIEZOELECTRIC TRANSDUCER

[75] Inventors: John F. Sear; Geoffrey M. Garner, both of Northampton, England

[73] Assignee: Plessey Handel und Investments AG, Zug, Switzerland

[21] Appl. No.: 742,059

[22] Filed: Nov. 15, 1976

Related U.S. Application Data

[63] Continuation of Ser. No. 581,664, May 28, 1975, abandoned.

[30] Foreign Application Priority Data

May 30, 1974 [GB] United Kingdom ..... 25370/74

[51] Int. Cl.[2] ..... H04R 17/00; H04R 17/02; H04R 17/10; B06B 1/06

[52] U.S. Cl. ..... 179/110 A; 179/121 D; 310/322; 310/332; 310/800

[58] Field of Search ..... 179/110 A, 121 R, 121 D, 179/139, 1 DM; 310/332, 356, 800, 322, 324

[56] References Cited

U.S. PATENT DOCUMENTS

| | | | |
|---|---|---|---|
| 2,121,779 | 6/1938 | Ballantine | 310/331 |
| 2,198,424 | 4/1940 | Baumzweiger | 179/1 DM |
| 2,323,030 | 6/1943 | Gruetzmacher | 310/9.1 |
| 2,910,545 | 10/1959 | Glenn | 310/334 |
| 2,967,956 | 1/1961 | Dranetz et al. | 310/334 |
| 3,107,630 | 10/1963 | Johnson et al. | 310/8.6 |
| 3,130,275 | 4/1964 | Hagey | 179/110 A |
| 3,222,462 | 12/1965 | Karmann et al. | 310/9.1 |
| 3,264,861 | 8/1966 | Miles | 310/8.6 |
| 3,287,692 | 11/1966 | Turner | 310/332 |
| 3,351,393 | 11/1967 | Emmerich | 310/8.6 |
| 3,660,602 | 5/1972 | Thompson | 179/1 A |
| 3,700,938 | 10/1972 | Bryant | 179/110 A |
| 3,715,500 | 2/1973 | Sessler et al. | 179/1 DM |
| 3,746,898 | 7/1973 | Austin et al. | 310/9.4 |
| 3,792,204 | 2/1974 | Murayama et al. | 179/110 A |
| 3,798,474 | 3/1974 | Cassand et al. | 310/8.5 |
| 3,947,644 | 3/1976 | Uchikawa | 179/110 A |

FOREIGN PATENT DOCUMENTS

| | | | |
|---|---|---|---|
| 1065880 | 9/1959 | Fed. Rep. of Germany | 179/110 F |
| 2116573 | 10/1972 | Fed. Rep. of Germany | 179/121 D |

*Primary Examiner*—George G. Stellar
*Attorney, Agent, or Firm*—Fleit & Jacobson

[57] ABSTRACT

A piezoelectric transducer including a member composed of at least two superposed plastics layers at least one of which is piezoelectric, the said at least one piezoelectric layer being sandwiched in an untensioned state between two electrically conducting electrodes; and support means for the said member which are adapted to form at least one transducer element from the said member.

22 Claims, 13 Drawing Figures

PIEZOELECTRIC TRANSDUCER

Figure 1:
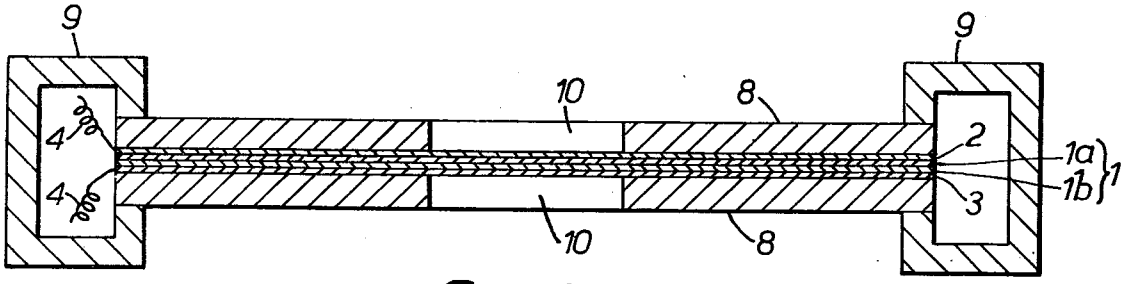

This is a continuation of application Ser. No. 581,664, filed May 28, 1975, now abandoned.

The invention relates to piezoelectric transducers.

Piezoelectric transducers in which an electrical output is obtained by using acoustic pressure to mechanically deform an inorganic piezoelectric material are well known. However, the usefulness of transducers of this kind is, particularly when used as a microphone in a telephone handset, limited by the mechanical properties of the transducer element and the relatively high cost of assembly of the transducer.

It is known that many plastics materials can be made to exhibit a piezoelectric effect after being subjected to various treatments which may involve heating, stretching, moulding and the application of electric fields.

The invention provides a piezoelectric transducer including a member composed of at least two superposed plastics layers at least one of which is piezoelectric, the said at least one piezoelectric layer being sandwiched in an untensioned state between two electrically conducting electrodes; and support means for the said member which are adapted to form at least one transducer element from the said member. All of the superposed plastics layers of the said member can be piezoelectric and with such an arrangement all of the layers would be sandwiched between the two electrically conducting electrodes. Adjacent piezoelectric layers can have an electrically conducting electrode sandwiched therebetween.

In one arrangement for the piezoelectric transducer, the support means can be provided by two rigid members which each have an aperture therein, the multi-layered member being sandwiched in an untensioned state between the two rigid members so that each rigid member is contiguous with a separate one of the surfaces of the said member, the apertures in the rigid members being in register. The aperture in each of the rigid members can be of any shape or form and the resonant frequency of the transducer is determined by the dimensions of the apertures and the thickness of the electroded multi-layered member.

In another arrangement for the piezoelectric transducer, the multi-layered member can be divided by the support means into a plurality of discrete regions which each form a separate transducer element and which are coupled together electrically parallel. The support means for this arrangement can be provided by two rigid members of a perforated material and the electroded multi-layered member would be sandwiched in an untensioned state between the two perforated members so that each perforated member is contiguous with a separate one of the surfaces of the multi-layered member, the apertures of the two members being in register. Alternatively, the support means can be provided by two rigid members between which the electroded multi-layered member would be sandwiched in an untensioned state, one of the rigid members having a number of apertures therein and being contiguous with one surface of the multi-layered member whilst that surface of the other rigid member which is contiguous with the other surface of the multi-layered member would be roughened or profiled.

The piezoelectric layer or layers of the multi-layered member can be of any plastics material which can be rendered piezoelectric but is preferably of a fluorinated hydrocarbon piezoelectric material such as polyvinylidene fluoride, polyvinylfluoride or fluorinated ethylene propylene copolymer. These piezoelectric plastics materials are of the kind that produce an electrical output for a given mechanical deformation which is substantially undiminished over a period of years or by ambient temperature and humidity variations.

Figure 3:
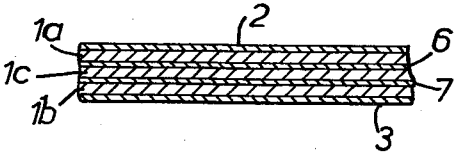
Figure 2:
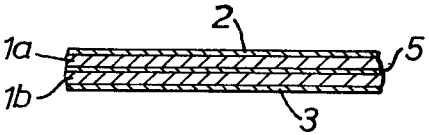
Figure 4:
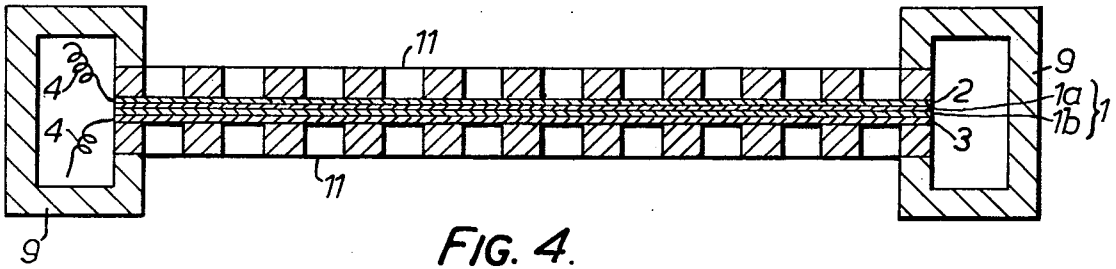
Figure 5:
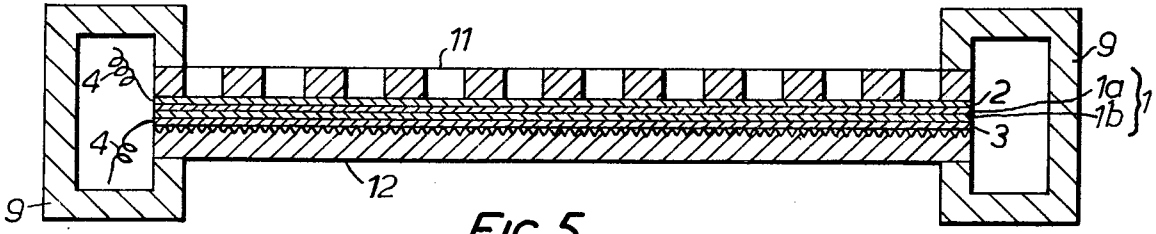
Figure 6:
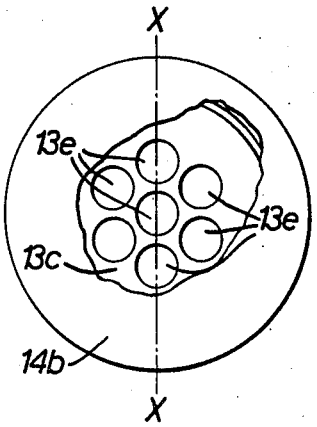
Figure 7:
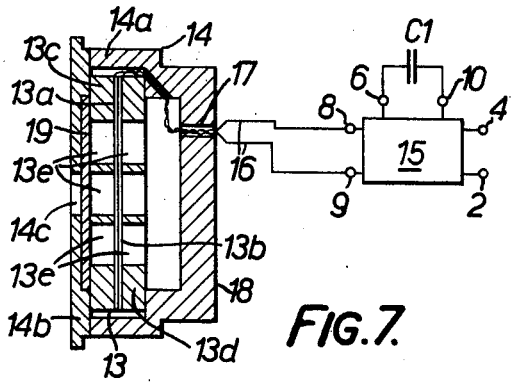
Figure 8:
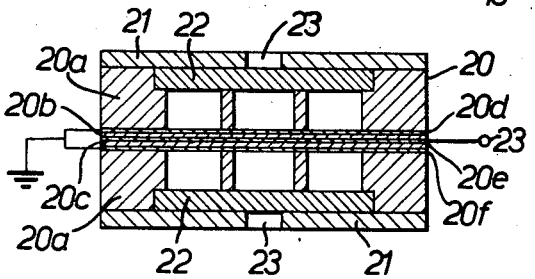
Figure 9:
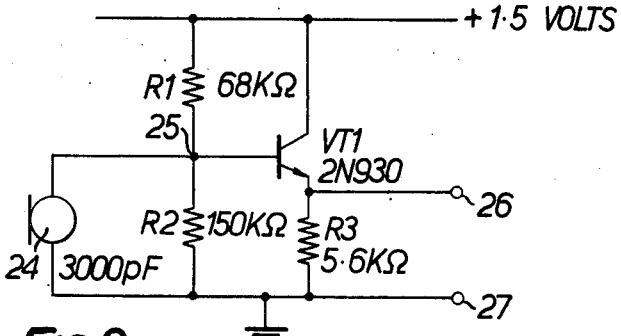

The foregoing and other features according to the invention will be better understood from the following description with reference to the accompanying drawings, in which:

FIG. 1 diagrammatically illustrates in a cross-sectional side elevation one arrangement for a piezoelectric transducer according to the invention, FIGS. 2 and 3 diagrammatically illustrate in cross-sectional side elevations further arrangements for the transducer element of the piezoelectric transducer of FIG. 1, FIGS. 4 and 5 diagrammatically illustrate in cross-sectional side elevations further arrangement for a piezoelectric transducer according to the invention, FIGS. 6 and 7 diagrammatically illustrate respectively in a partly cut-away front elevation and a cross-sectional side elevation on the line 'x—x' of FIG. 6, one arrangement for a microphone which is suitable for use as a direct replacement for the carbon granule microphone used in telephone handsets, FIG. 8 diagrammatically illustrates in a cross-sectional side elevation a noise-cancelling microphone which utilizes a piezoelectric transducer according to the invention, FIG. 9 illustrates an impedance matching circuit for the noise-cancelling microphone of FIG. 8, and FIGS. 10A to 10C and FIG. 11 diagrammatically illustrate second order pressure gradient noise-cancelling microphones which utilize the piezoelectric transducers according to the invention.

Referring to FIG. 1 of the drawings, the piezoelectric transducer diagrammatically illustrated therein in a cross-sectional side elevation is one arrangement according to the invention and includes a member 1 composed of two layers 1*a* and 1*b* of a piezoelectric plastics material, for example a fluorinated hydrocarbon piezoelectric material such as polyvinylidene fluoride, polyvinylfluoride or fluorinated ethylene propylene copolymer. The piezoelectric layers 1*a* and 1*b* are in close contact and may be, but are not necessarily, bonded together. The direction of polarisation of the layers 1*a* and 1*b* is such that known piezoelectric flexure structures can be formed. Such structures are described as series or parallel bimorphs. In practice, this means that the plane of polarisation of the layers 1*a* and 1*b* is normal to the major surfaces thereof and the polarisation of the layers may be in the same or opposite directions depending on whether a parallel or series bimorph is required.

The member 1 which can be circular, is of a thickness that is preferably within the range 10 to 100 micrometers but may be in the range 5 to 500 micrometers.

Two thin electrically conductive electrodes 2 and 3 are provided, one on each of the two major surfaces of the member 1, for detecting an electrical potential developed across the major surfaces. The electrodes 2 and 3 which can be provided by painting or evaporating the electrode material onto the major surfaces of the member 1 are each connected by means of connecting leads 4 to terminal pins or the like (not illustrated). In practice, the terminal pins or the like will be connected to suitable impedance matching and amplification devices.

As is diagrammatically illustrated in FIG. 2 of the drawings which shows part of a modified arrangement of the member 1 of FIG. 1, another thin electrically conductive electrode 5 can be provided between the piezoelectric layers 1*a* and 1*b* of the member 1 and when the polarisations of the layers 1*a* and 1*b* are in the opposite directions then this structure is known as a series bimorph.

Other composite structures for the member 1 of FIG. 1 can have any number of piezoelectric layers, for example, as is diagrammatically illustrated, in part, in FIG. 3 of the drawings, a composite structure can be compared of three piezoelectric layers 1*a*, 1*b* and 1*c* sandwiched between the electrodes 2 and 3 and having thin electrically conductive electrodes 6 and 7 respectively provided between the layers 1*a* and 1*c* and the layers 1*c* and 1*b*. In an alternative arrangement the electrodes 6 and 7 can be omitted; the layers 1*a* to 1*c* being in close contact and possibly, although not necessarily, bonded together.

Another structural arrangement which may be used for the member 1 is one in which only one of the layers 1*a* and 1*b*, e.g. the layer 1*a*, is piezoelectric, the electrode 3 being situated between the layers 1*a* and 1*b*. This structure is known as a unimorph.

The electroded member 1 which may have anyone of the structures outlined in preceding paragraphs, is, as is illustrated in FIG. 1, sandwiched between two rigid members 8, the sandwiched structure being clamped together by means of a peripheral clamping arrangement 9. The members 8 each have an aperture 10 therein and the sandwiched structure is arranged so that the apertures 10 of the two rigid members 5 are in register, that part of the member 1 exposed by the apertures 10 forming both the diaphragm and the transducing member for the piezoelectric transducer.

The apertures 10 may be of any shape or form, for example, in the form of a circle or a regular or irregular polygon with a diameter or maximum diagonal dimension within the range 0.05 to 100mm, the preferred range being 1.0 to 15 mm.

In practice, the piezoelectric transducer of FIG. 1 is mounted in a manner determined by the particular application in which it is being used, and may be mounted so that the front surface is acoustically isolated from the rear surface, or is separated from the rear surface by a well defined acoustic path length.

The resonant frequency of the transducer is determined by the dimensions of the apertures 10 and the thickness of the multi-layered structure and can be situated anywhere in the audio or ultrasonic region by suitable choice of these dimensions.

In another arrangement for the piezoelectric transducer according to the invention which is diagrammatically illustrated in a cross-sectional side elevation in FIG. 4 of the drawings, the electroded member 1 is sandwiched between two rigid members 11 of a perforated material, the sandwiched structure being clamped together by means of the peripheral clamping arrangement 9 and arranged so that the perforations of the two rigid members 11 are in register.

The two rigid members 11 divide the electroded member 1 into a plurality of discrete regions which each form a separate transducer element and which are coupled together electrically in parallel, the member 1 forming both the diaphragm and the transducing member of each of the transducer elements.

In a further arrangement for the piezoelectric transducer according to the invention which is diagrammatically illustrated in a cross-sectional side elevation in FIG. 5 of the drawings and which is a modified arrangement of the piezoelectric transducer of FIG. 4, one of the rigid perforated members 11 of FIG. 4 is replaced by a rigid member 12 having that surface thereof which is in contact with the electrode 3 roughened or profiled.

In both of the piezoelectric transducer arrangement of FIGS. 4 and 5, the perforations or holes in the rigid member or members 11 may be of any shape and of a size limited only by the required acoustic performance and the necessity of rendering each of the separate transducer elements self supporting, but are preferably in the form of a circle or a polygon with a diameter or diagonal dimension within the range 0.05 to 10 mm. Variations in the size of the holes within this range can be used in the arrangement of FIG. 4 in order to effect a variation in the acoustic resonance of the structure and to thereby effect control of its response. With the arrangement of FIG. 5, variations in the size of the holes in the rigid member 11 and variations in the surface roughness or pattern profile in the rigid member 12 may be used to effect the same results.

It should be noted that the piezoelectric transducers according to FIGS. 4 and 5 can utilise any one of the piezoelectric structures outlined in preceding paragraphs for the member 1.

As previously stated, the electroded member 1 of FIGS. 4 and 5 is divided into a plurality of discrete regions which each form a separate transducer element and which are coupled together electrically in parallel. The area of each of the discrete regions is determined in the arrangement of FIG. 4 by the size of the registering perforations in the members 11 and in the arrangement of FIG. 5 by the combined effect of the perforations in the member 11 and the surface roughness and/or pattern of the member 12.

Each of the separate transducer elements behaves as a simple transducer whose acoustic performance is governed by its physical dimensions, but all of the separate transducer elements work co-operatively in parallel to produce a transducer having a resonant frequency that can be placed either within or remote from the frequency band of interest if the perforations in the members 11 are of the same size. Alternatively, the resonance of the transducer can be smoothed out to give any desired frequency responce by having a range of different sized perforations with different resonances in each of the members 11.

The impedance of the piezoelectric transducers of FIGS. 4 and 5 is determined by the total dimensions of the member 1 and can, therefore, be made relatively low to effect a desired impedance match into any conventional impedance matching and amplification circuitry.

The overall sensitivity of the piezoelectric transducers according to the invention can be controlled by variation of the piezoelectric co-efficient of the member 1 which is readily achieved by varying the polarising conditions during the process carried out to make the plastic piezoelectric or by varying the ratio of hole area to the total area of the member 1; for maximum sensitivity this ratio should approach as closely as possible to unity whilst retaining a rigid clamping support structure for the electroded member 1.

Other advantages of the piezoelectric transducer according to the present invention are that (a) the transducer structures are easily constructed and thereby relatively cheap to manufacture, (b) the piezoelectric plastics member 1 is in an untensioned state and thereby gives high sensitivity and freedom from long term sensitivity variations due to plastic creep, (c) the use of a light plastic transducer confers robustness, good transient response and freedom from solid borne noise, (d) the relatively small front to rear dimension of the transducer allows noise cancelling techniques to be applied by permitting the easy assembly of coaxial transducer arrays, and (e) the inherent symmetry of the plastic transducer/diaphragm enables improved matching of the front and rear acoustic characteristics of the device, which is an advantage in the construction of noise cancelling microphones.

The piezoelectric transducers according to the present invention have a particular but not necessarily an exclusive application as microphones in telephone handsets, the acoustic pressure causing mechanical deformation of the exposed region or regions of the member 1, and thereby the development of an electrical potential between the electrodes 2 and 3 representative of the acoustic pressure.

FIGS. 6 and 7 of the drawings diagrammatically illustrate respectively in a partly cut-away front elevation and a cross-sectional side elevation on the line 'x—x' of FIG. 6 one arrangement for a microphone which is suitable for use as a direct replacement for the carbon granule microphone used in telephone handsets.

The microphone arrangement of FIGS. 6 and 7 includes a piezoelectric transducer 13 according to the present invention housed within an enclosure 14 and connected to an integrated circuit amplifier 15.

The piezoelectric transducer 13 includes two piezoelectric plastic layers 13*a*, and 13*b* which are polaris in opposite directions and electrically connected in series and which are electroded with a metal such as aluminum or g.

The two piezoelectric layers 13*a* and 13*b* are rolled together and supported in an edge-clamped configuration between two clamping plates 13*c* and 13*d* which have coincident circular apertures 13*a* therein.

In a practical arrangement, the plates 13*c* and 13*d can be of* 3mm thick polycarbonate, the apertures 13*a* can be 6mm in diameter, the layers 13*a* and 13*b* can be each of 25 μm thick polyvinylidene fluoride having a piezoelectric coefficient of $10pCN^{-1}$ obtained by applying an electric field of $1.6MVcm^{-1}$ across the film thickness at a temperature of 90° C., and the aluminum electrodes can be 1000Å thick and deposited by vacuum evaporation. Thus the individual transducer/diaphragm disc elements formed by the plates 13*c* and 13*d* are 50μm thick and 6mm in diameter and are, therefore, self-supporting and behave mechanically as stiff plates. The disc elements are untensioned and, therefore, plastic 'creep' problems are avoided. The disc elements are brought into flexural vibration by sound waves, the output being an alternating voltage of the same frequency.

The integrated circuit amplifier can be provided by a commercially available Mullard TAA970 microphone amplifier, the amplifier terminals being identified in FIG. 7 with the reference numerals that are used to identify the corresponding terminals on the Mullard TAA970 amplifier. The terminals 8 and 9 are connected to the aluminium electrodes of the transducer 13 by means of insulated connecting leads 16, the terminals 2 and 4 are the output terminals forthe microphone and a 0.22 μF capacitor C1 is connected between the terminals 6 and 10. The leads 16 pass through a 1 mm diameter hole 17 in the main body 14*a* of the enclosure 14. In a practical arrangement, the microphone amplifier and capacitor C1 would be suitably mounted on the surface 18 of the body 14*a* in a manner whereby the enclosure 14 acts as a heat sink for the amplifier. Also, the front electrode and that one of the leads 16 which is connected to the terminal 9 could be connected to a metal enclosure 14 to effect screening of the assembly.

The acoustic design of the microphone is entirely in front of the disc elements of the transducer. A protective front plate 14*b* of the enclosure 14 has a hole pattern 14*c* therein which together with the mouthpiece of the telephone handset acts as a protective shield against touching the transducer element.

A foam disc 19, for example, of polyester is interposed between the transducer 13 and the front plate 14*b* and is located in a recess in the front plate 14*b*. In the practical arrangements previously referred to, the recess in the front plate 14*b* would be 1.5 mm deep and would be filled with a 3.5 cm diameter compressed disc of 5 mm thick polyester foam having a linear pore count of 20 pores/cm.

The recess and the foam disc 19 give rise to a low Q resonance in the aforementioned practical arrangements at approximately 1 KHz. The depth of the recess and the volume of air in the entire front cavity of the microphone define the resonant frequency whilst the Q of the resonance is mainly dependent upon the linear pore count of the disc 19. The disc 19 which acts as an acoustic resistance due to the viscous friction between air particles as the sound wave is transmitted through the porous material, also acts as a windshield discriminating against high velocity air streams produced by the wind but allowing acoustic pressures to pass through.

The hole 17 is adapted to provide equalisation of the pressure variations on both sides of the diaphragms at frequencies less than 100 Hz.

Also, because of the reversible nature of the piezoelectric effect, the transducers outlined in preceding paragraphs may be used equally well as receivers or generat of sound and may be utilized not only in microphones but also in earphones and in applications such as ultrasonic transmitters and receivers, hydrophones etcetera.

The piezoelectric transducers according to the invention have particular advantages in relation to microphones, especially miniature microphones because the capacitance of a piezoelectric transducer is of a value which allows impedance matching of the transducer to be readily effected. In a typical first order gradient noise cancelling microphone of known type, a carefully controlled acoustic path length difference is incorporated between the front and rear surfaces of the diaphragm, in more complex microphones a number of such units are arranged co-axially in a linear array or a single diaphragm is subjected at front and rear to sounds introduced by a four port arrangement. Microphones of conventional type utilize mechanical linkages, electromagnets etcetera and because of this it is extremely difficult to arrange the required acoustic path lengths and the linear configuration previously referred to without making the microphone unwieldly and unsuitable as a practical device. It is also difficult for the same reason to obtain the required good matching of the front and rear acoustic components of a noise cancelling microphone. However, with the piezoelectric transducers according to the present invention, the restriction caused by the relatively bulky mechanisms of known microphone arrangements is avoided because the diaphragm and the transducer are constituted by the same composite piezoelectric member, the thickness dimension of the composite piezoelectric member is inherently small and the composite piezoelectric member and its associated supports are inherently symmetrical. Thus an efficient single diaphragm noise cancelling microphone or an array of such units of optimum dimensions can be readily achieved with all the previously stated advantages of robustness, long term stability etcetera.

A noise-cancelling microphone is diagrammatically illustrated in FIG. 8 of the drawings in a cross-sectional side elevation and includes a piezoelectric transducer 20 according to the invention, two protective plates 21 situated one on each side of the transducer 20 and two foam discs 22 which are each interposed between the transducer 20 and a separate one of the plates 21. The discs 22 are each preferably located within a recess in a separate one of the apertured clamping plates 20*a* of the transducer 20.

The transducer 20 includes two piezoelectric layers 20*b* and 20*c* which are polarised in the same direction and electrically connected in parallel and which have electrodes 20*d*, 20*e* and 20*f* associated therewith.

The layers 20*b* and 20*c* are rolled together and supported in an edge-clamped configuration between the plates 20*a* which have coincident circular apertures 20*g* therein.

In a practical arrangement, the plates 20*a* can be of 5 mm thick material, for example brass, or metallised plastic, the apertures 20*g* can be 5 mm in diameter, the layers 20*b* and 20*c* can each be of 16 μm thick polyvinylidene fluoride having a piezoelectric coefficient of $10pCN^{-1}$ obtained by applying an electric field of 1 $MVcm^{-1}$ across the film thickness at a temperature of 90° C., and the electrodes 20*d*, 20*e* and 20*f* can be of 1000 Å thick metal films of say gold deposited by vacuum evaporation. Thus, the individual transducer/diaphragm disc elements formed by the plates 20*a* are 32 μm thick amd 5 mm in diameter and are, therefore, self-supporting and behave mechanically as stiff plates. The disc elements are untensioned and, therefore, plastic 'creep' problems are avoided. The disc elements are brought into flexural vibration by sound waves, the output being an alternating voltage of the same frequency. The output voltage is taken from the centre electrode 20*e* which is connected to an output terminal 23 and the electrodes 20*d* and 20*f* are connected to earth potential. The output terminal 23 is, in a practical arrangement, connected to an impedance matching circuit.

The acoustic design of the microphone of FIG. 8 is entirely to the front and rear of the disc elements of the transducer in a symmetrical arrangement. The protective plates 21 which can be of aluminium and which act as protective shields against touching the transducer element, each have a single hole 23 therein. In the practical arrangement previously referred to, the hole 23 would be 3 mm in diameter, the recesses in the plates 20*a* would be 18 mm in diameter and 1.5 mm deep and the discs 22 would each be in the form of an 18 mm diameter compressed disc of 5 mm thick polyester foam having a linear pore count of 30 pores/cm.

The microphone of FIG. 8 is a noise-cancelling first order pressure gradient operated device. Its characteristics derive from the fact that gradient microphones are more sensitive to spherical waves than to plane waves. Sound waves of speech are spherical in character near the mouth, whereas the wavefronts of distant noise sources are nearly plane in comparison with the relatively small dimensions of the microphone. In addition, the acoustic signal to noise ratio is increased due to the figure-of-eight directional characteristic associated with first order devices.

The capacitance of the previously referred to practical arrangement of the microphone of FIG. 8 is 3000 pF when measured at a frequency of 1 kHz in a capacitance bridge and the impedance matching for the microphone can be effected in a manner as is illustrated in FIG. 9 of the drawings.

The microphone of FIG. 8 is indicated in FIG. 9 by the reference 24 and the impedance matching is effected with an emitter follower pre-amplifier circuit which should preferably be mounted close to the microphone in order to convert the high impedance of the microphone to a practical value of about 500 ohms. The pre-amplifier circuit includes a transistor VT1 having the collector thereof connected to a potential of 1.5 volts, the emitter thereof connected to earth potential via a resistance R3 and the base thereof connected to the junction 25 of two resistances R1 and R2 which are connected in series between earth potential and the 1.5 volts supply. The microphone 24 is connected between earth potential and the junction 25, and the low impedance output of the circuit is taken across the resistance R3 by means of output terminals 26 and 27.

The microphone arrangement of FIGS. 8 and 9 is not susceptible to electromagnetic pick-up due to the use of a parallel bimorph connection arrangement for the transducer, the signal voltage being taken from the centre electrode 20*e* which is shielded from external electromagnetic fields by the outer earthed electrodes 20*d* and 20*f* and the microphone housing. Furthermore, the microphone arrangement is insensitive to solid-borne vibration because the total effective mass per unit area of the diaphragm is relatively low i.e. $1.3\times10^{-3}$ $gm.cm^{-2}$ in the practical arrangement previously referred to. As a consequence of this the microphone arrangement is very robust since the possibility of damage from shock is extremely remote.

Figure 10A:
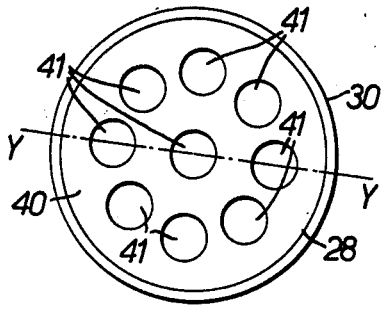
Figure 10B:
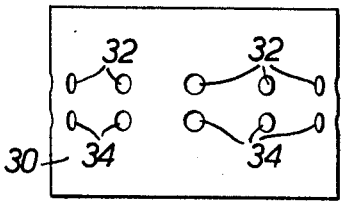
Figure 10C:
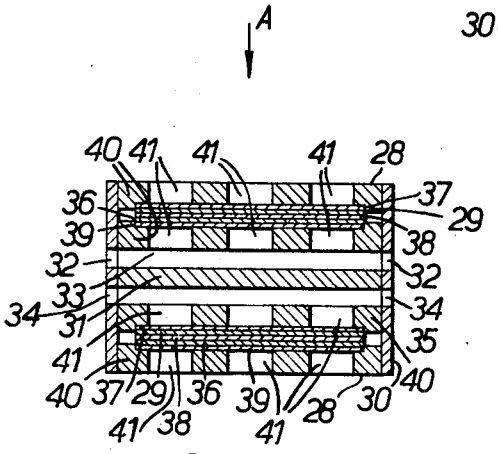

Higher order pressure gradient microphones can be obtained by arranging first order pressure gradient units in suitable combinations, for example, a second order pressure gradient microphone can, as is diagrammatical illustrated in FIGS. 10A to 10C of the drawings, be constructed from two first order pressure gradient units with their electrical outputs connected in opposition.

As illustrated in FIGS. 10A to 10C, the second order pressure gradient microphone includes two transducers 28 situated one at each end of an enclosure 30 and acoustically separated from each other by a sound proof disc 31. A number of holes 32 and 33 are provided in the enclosure 30 for respectively providing sound ports for the space 33 and the space 35.

The transducers 28 each include two piezoelectric layers 29 and 36 which have electrodes 37 to 39 associated therewith. The layers 29 and 36 which can be polarised in any desired direction and be electrically connected either in series or in parallel, are rolled together and supported in an edge-clamped configuration between two plates 40 which have coincident circular apertures 41 therein.

In practice, the line of sound wave propagation is directed along a path indicated in FIG. 10C by the arrow 'A', i.e. towards the front of the microphone.

The two transducers 28 are, therefore, positioned one behind the other, preferably on a common axis along the line of sound wave propagation, the distance between the transducers 28 being small compared with the wavelength of the sound waves and such that there is an optimum amount of phase difference in the acoustic path between the diaphragms of the transducers. The acoustic response of this combination is proportional to the difference in the pressure gradients at two closely spaced points in the acoustic field, i.e. the force experienced by each diaphragm as a result of the sound waves that are applied thereto via the holes 32, 34 and 41 gives rise to a second order pressure gradient effect and the microphone thereby exhibits a higher degree of noise discrimination than a simple first order pressure gradient unit.

Third order pressure gradient microphones can be constructed by using pairs of second order pressure gradient units arranged in a similar manner to the arrangement of FIGS. 10A to 10C.

It should be noted that in a practical arrangement for the microphone of FIGS. 10A to 10C an apertured protective plate would be provided at each end of the enclosure 30 and an acoustic resistance in the form of a foam disc would be situated between each protective plate and the associated transducer.

Figure 11:
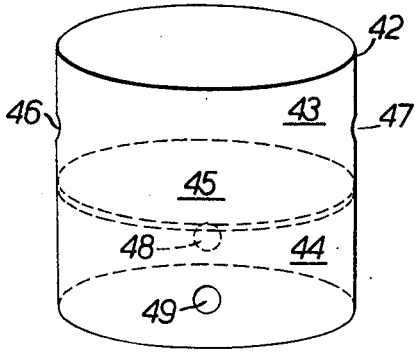

A second order pressure gradient microphone can, as is diagrammatically illustrated in FIG. 11 of the drawings in a pictorial view, also be constructed using only one of the transducers 28 of FIGS. 10A to 10C. With this microphone arrangement, a cylinder 42 which is closed at each end thereof, is divided into two separate chambers 43 and 44 by the piezoelectric transducer which is indicated by the reference 45 and which can have the same structural arrangement as the transducer 28 of FIGS. 10A to 10C but could be provided by any one of the piezoelectric transducers outlined in preceding paragraphs where external sounds can have access to both sides of the diaphragm. Two sound ports 46 and 47 for the chamber 43 and two sound ports 48 and 49 for the chamber 44 are formed in the wall of the cylinder 42 and the spacing of the sound ports 46 and 49 is arranged so that the transducer 45 experiences a force proportional to the second order of the pressure gradient.

A second order pressure gradient microphone is one whose output depends on pressure variations at four points in space and in the microphone arrangement of FIGS. 10A to 10C the four points are provided by the front and rear surfaces of each of the transducers 28 whereas with the microphone arrangement of FIG. 11, the sound ports 46 to 49 allow sound pressures to act on different sides of a single transducer 45. The sound ports 46 and 48 together form one first order pressure gradient unit and the sound ports 47 and 49 together form a second first order pressure gradient unit. By arranging for the sound ports which are opposite to each other to admit pressures to the same surface of the transducer 45, the resultant force is the difference of the forces obtained from the two first order pressure gradient combinations; the effective force on the diaphragm is then proportional to the second order of the pressure gradient, which is the characteristic of a second order microphone.

It should be noted that the metal used for the electro of the multi-layered member must be such that it adheres to the plastics material and does not corrode under the intended conditions of use and that, in practice, when gold electrodes are used for the electroded multi-layered member, a thin layer of nichrome is interposed between the gold electrode and the plastic material in order to ensure good adhesion.

It should also be noted that the electrodes, such as the electrodes 6 and 7 of FIG. 3 and the electrode 5 of FIG. 2, sandwiched between the plastics layers of the multi-layered member would in practice be formed by two electrode layers because each plastics layer would, prior to assembly into the multi-layered structure, be formed with two electrodes thereon and polarised as required.

It is to be understood that the foregoing description of specific examples of this invention is made by way of example only and is not to be considered as a limitation in its scope.

What is claimed is:

1. A piezoelectric transducer including a substantially solid member composed of at least two superposed plastics layers, each layer being substantially flat and continuous and at least one layer being piezoelectric, said member having a thickness of between 10 and 500 micrometers throughout, the said at least one piezoelectric layer being sandwiched between two electrically conducting electrodes which are continuous across at least the operative portion of the surface of the said at least one piezoelectric layer; and support means for the said member which are adapted to form, from the said member, at least one transducer element which is in an untensioned state and which is rigidly supported and edge clamped about the entire periphery thereof such that the said member is incapable of transmitting vibratory energy at the edge-clamped periphery to said support means.

2. A piezoelectric transducer as claimed in claim 1, wherein said transducer element is rigidly supported and edge-clamped about the entire periphery thereof at opposite annular surfaces of the said member.

3. A piezoelectric transducer including a substantially solid member composed of at least two superposed fluorinated hydrocarbons selected from the group consisting the polyvinylidene fluoride, polyvinylfluoride and fluorinated ethylenepropylene copolymer layers, each layer being substantially flat and continuous and at least one layer being piezoelectric, said members having a thickness in the range of 5 to 500 micrometers throughout, the said at least one piezoelectric layer being sandwiched between two electrically conducting electrodes which are continuous across at least the operative portion of the surface of the said at least one piezoelectric layer; and support means for the said member which is adapted to form, from the said member, at least one transducer element which is in an untensioned state and which is rigidly supported and edge clamped about the entire periphery thereof such that there is no significant transfer of energy between the said member and the support means, said support means including two rigid members so that each rigid member is contiguous with a separate one of the surfaces of the multi-layered member, the apertures in the rigid members being in register, wherein the rigid members maintain the multi-layered member stationary therebetween at the areas where the rigid members are contiguous with the multi-layered member and wherein the resonant frequency is determined by the aperture dimensions and the thickness of the multi-layered member.

4. A piezoelectric transducer including a substantially solid member composed of at least two superposed plastics layers, each layer being substantially flat and continuous, at least one layer being piezoelectric and of uni-directional polarization throughout, said member having a thickness between 10 and 500 micrometers throughout, the said at least one piezoelectric layer being sandwiched between two electrically conducting electrodes which are continuous across at least the operative portion of the surface of the said at least one piezoelectric layer; and support means for the said member which are adapted to form, from the said member, at least one transducer element which is in an untensioned state and which is rigidly supported and edge clamped about the entire periphery thereof such that there is no significant transfer of energy between the said member and the support means.

5. A piezoelectric transducer as claimed in claim 4 wherein the support means include two rigid members which each have an aperture therein, the electroded multi-layered member being sandwiched in an untensioned state between the two rigid members so that each rigid member is contiguous with a separate one of the surfaces of the multi-layered member, the apertures in the rigid members being in register, and wherein the resonant frequency is determined by the aperture dimensions and the thickness of the multi-layered member.

6. A piezoelectric transducer as claimed in claim 4 wherein the thickness of the multi-layered member is in the range 10 to 100 micrometers.

7. A receiver which includes a piezoelectric transducer as claimed in claim 4.

8. A piezoelectric transducer as claimed in claim 4 wherein the or each piezoelectric layer is polarised in a plane normal to the major surfaces thereof, and wherein the direction of polarisation of the or each piezoelectric layer is arranged so that a piezoelectric flexure structure is provided.

9. A piezoelectric transducer as claimed in claim 4 wherein adjacent piezoelectric layers have an electrically conducting electrode sandwiched therebetween.

10. A piezoelectric transducer as claimed in claim 4, wherein said transducer element is rigidly supported and edge-clamped about the entire periphery thereof at opposite annular surfaces of the said member.

11. A piezoelectric transducer as claimed in claim 4 wherein all of the superposed plastics layers are piezoelectric and sandwiched between the two electrically conducting electrodes.

12. A piezoelectric transducer as claimed in claim 4, wherein the piezoelectric layer or layers of the multi-layered member are of a fluorinated hydrocarbon piezoelectric material.

13. A piezoelectric tranducer as claimed in claim 12 wherein the fluorinated hydrocarbon piezoelectric material is a material selected from the group which comprises polyvinylidene fluoride, polyvinylfluoride and fluorinated ethylene propylene copolymer.

14. A microphone which includes at least one of the piezoelectric transducers as claimed in claim 4.

15. A microphone as claimed in claim 14 including a piezoelectric transducer which is such that external sound pressure can have access to both sides of the electroded multi-layered member; and a cylinder which is enclosed at each end thereof, which is divided into two separate chambers by the piezoelectric transducer and which has two sound ports for each of the chambers formed in the cylinder wall, the sound ports of each chamber being diametrically opposite each other.

16. A microphone as claimed in claim 14 which also includes for at least one side of the or each piezoelectric transducer, an apertured member for protecting the or each transducer element; and an acoustic resistance interposed between the apertured member and the or each transducer element.

17. A microphone as claimed in claim 16 which also includes an impedence matching network connected to the output of the piezoelectric transducer or transducers.

18. A piezoelectric transducer including a substantially solid member composed of at least two superposed plastics layers at least one of which is piezoelectric, said member having a thickness of not greater than 500 micrometers throughout, the said at least one piezoelectric layer being sandwiched between two electrically conducting electrodes; and support means for the said member which are adapted to form, from the said member, a plurality of transducer elements, the transducer elements being coupled together electrically in parallel, and wherein the resonant frequency is determined by the aperture dimensions and the thickness of the member.

19. A piezoelectric transducer as claimed in claim 18 wherein the support means include two rigid members of a perforated material, the member being sandwiched in an untensioned state between the two perforated members so that each perforated member is contiguous with a separate one of the surfaces of the member, the apertures of the perforated members being in register, and wherein the resonant frequency is determined by the aperture dimensions and the thickness of the member.

20. A piezoelectric transducer as claimed in claim 18 wherein the support means include two rigid members between which the member is sandwiched in an untensioned state so that each rigid member is contiguous with a separate one of the surfaces of the member, wherein one of the rigid members has a number of apertures therein and wherein that surface of the other rigid member which is contiguous with the member is roughened or profiled, and wherein the resonant frequency is determined by the aperture dimensions and the thickness of the member.

21. A microphone which includes two piezoelectric transducers situated one at each end of an enclosure member; a sound proof member for acoustically separating the transducers from each other, the sound proof member being spaced apart from each of the transducers, the enclosure member having a number of apertures therein for providing sound ports for the spaces on each side of the sound proof member, wherein each of said piezoelectric transducers include a substantially solid member composed of at least two superposed plastics layers at least one of which is piezoelectric, said member having a thickness of not greater than 500 micrometers throughout, the said at least one piezoelectric layer being sandwiched between two electrically conducting electrodes; and support means for the said member which are adapted to form, from the said member, at least one transducer element which is rigidly supported and clamped at the periphery thereof and which is an untensioned state.

22. A microphone as claimed in calim 21 which also includes an apertured member for one side of each piezoelectric transducer for protecting the or each transducer element; and an acoustic resistance interposed between each apertured member and the associated transducer.

* * * * *